United States Patent [19]

Elsner et al.

[11] 4,287,933

[45] Sep. 8, 1981

[54] CONTINUOUS CASTING METHOD WITH ROTARY MELT MOVEMENT

[75] Inventors: Emil Elsner, Baden-Baden; Leo Heinen, Kehl, both of Fed. Rep. of Germany

[73] Assignee: Korf-Stahl AG, Baden-Baden, Fed. Rep. of Germany

[21] Appl. No.: 956,380

[22] Filed: Oct. 31, 1978

[30] Foreign Application Priority Data

Nov. 4, 1977 [DE] Fed. Rep. of Germany ..... 2749405

[51] Int. Cl.[3] ..... B22D 11/04; B22D 11/10

[52] U.S. Cl. ..... 164/452; 164/475; 164/473

[58] Field of Search ..... 164/66, 82, 415, 56, 164/71, 55; 222/591; 366/101, 107; 266/233; 75/59, 60

[56] References Cited

U.S. PATENT DOCUMENTS

| | | | |
|---|---|---|---|
| 3,398,935 | 8/1968 | Livesey et al. | 366/101 |
| 3,558,256 | 1/1971 | Bick et al. | 164/415 |
| 3,634,065 | 1/1972 | Worner | 75/60 X |
| 3,776,295 | 4/1973 | Mola et al. | 164/82 X |
| 4,079,868 | 3/1978 | Moniot | 222/591 |

*Primary Examiner*—Robert D. Baldwin

[57] ABSTRACT

Continuous metal casting method, especially continuous steel casting method, in which the melt is set in rotation about the strand axis within the continuous casting mold and gas in the gaseous or liquid state is fed onto the bath surface excentrically to the mold axis and at an acute angle to the velocity vector of the rotatory movement. The rotatory movement of the melt is brought about substantially by the thrust of the gas directed at high velocity onto the bath surface. The apparatus for the practice of the method has circumferentially of the mold, at least 2 terminal fittings of gas feed lines, whose discharge orifices are so constructed that a rotatory movement of the melt is brought about substantially by the thrust of the gas directed at high velocity against the bath surface.

12 Claims, 6 Drawing Figures

CONTINUOUS CASTING METHOD WITH ROTARY MELT MOVEMENT

BACKGROUND

Figure 1:
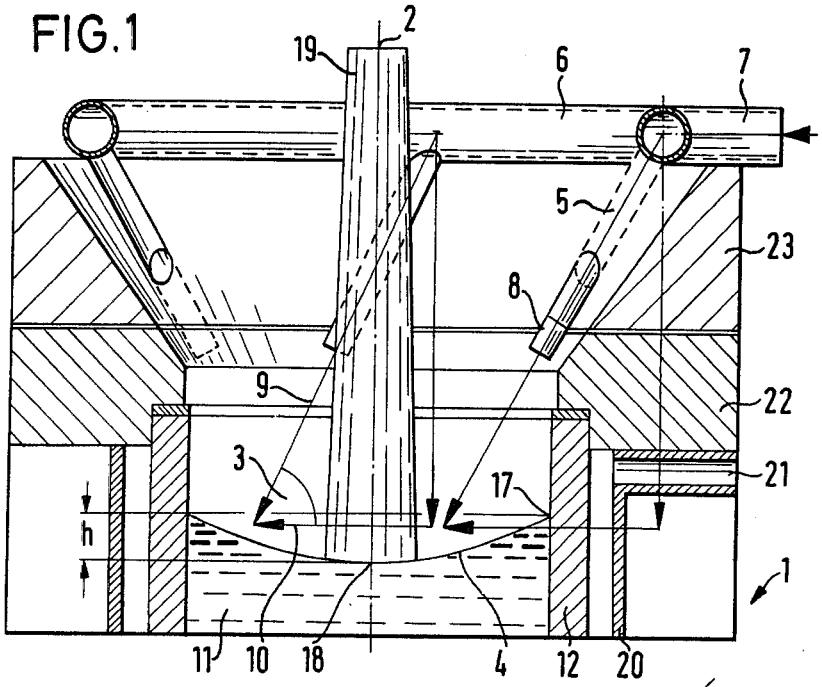

The invention relates to a continuous casting method, especially a continuous steel casting method, and to an apparatus for the practice of the method.

For the economical practice of the continuous casting process, very high rates of descent are necessary. The resulting long solidification stretches are a peculiar characteristic of the continuous steel casting process. The steel strand solidifies commonly from the outside towards the center. On this account, and due to the leading of oriented crystals, which is known as bridging, solidification voids are formed in the core. The rest of the melt, in which the segregating elements are concentrated, also solidifies in the core. Thus, core segregations develop, which become visible in the form of a black spot on etched transverse sections.

When the continuous casting process is used for the manufacture of high-grade steels, it becomes necessary to reduce core porosity and core segregation. For this purpose, it is the general practice in the casting of high-grade steels to operate at low temperature, at a slow pouring rate, with appropriate spray cooling, and with careful alignment of the continuous casting apparatus. Some of these measures, however, result in a negative influence on the output of the continuous casting plant. Consequently there has been a search for better solutions.

One possibility is the use of an electromagnetic rotating field to act upon the still molten inner part of the strand. For this purpose, induction coils are disposed above, below or also around the continuous casting mold, which have the purpose of keeping the molten metal in movement, so as to reduce the segregation, promote degassing, prevent the incorporation of slag and bring about a change in the shape of the pool of the molten metal in the mold. In addition to rotating fields by which the molten core of the strand is set in rotation, linear fields are also used for the purpose of stirring the molten metal along horizontal or vertical axes. Core segregation and core porosity can be reduced in this manner. Inclusions, which in the case of curved-strand continuous casting installations collect mainly on the inside of the curve, are uniformly distributed over the cross section.

If induction coils are disposed underneath the mold, it becomes difficult to incorporate the coils into the strand guiding framework. Spray cooling usually has to be omitted in the vicinity of the coils. If break-offs occur, the coils are easily destroyed.

If induction coils are to be provided around or inside of the continuous casting mold, design difficulties are again involved. Furthermore, additional measures are necessary in order to make it possible for the magnetic field to penetrate through the wall of the copper mold.

In addition to electromagnetic stirring means for the production of a stirring or turning movement in the molten core of the strand, rotatory strand casting methods have become known in which the mold is set in rotation with the strand. In this manner a rotatory movement of the molten core is likewise produced. These methods, however, can be applied only in vertical continuous casting systems producing strands of round cross sectional shape.

German Auslegeschrift No. 2,163,928 discloses a metal strand casting method, especially a continuous casting method, in which the melt is set in rotation about the strand axis within the continuous casting mold, either by means of electromagnetic fields or by the rotation of the mold and of the strand, and an inert liquid gas is fed onto the bath surface in the continuous casting mold. Liquid nitrogen or liquid argon can be used as the liquid gas. By combining the feeding of an inert gas in liquid form with the rotation of the melt by electromagnetic fields or by rotating the mold and the strand, an improvement in quality is achieved. The gas must be delivered in liquid form onto the bath surface, because only then can an excellent distribution of the liquid gas be achieved when it contacts the bath surface, and this is essential to achieving the desired result. The liquid gas must be delivered at a rate which will not disturb the state of the surface of the bath.

In this method, too, either an induction coil or a rotation of the mold and steel strand are necessary for the production of the rotatory movement of the melt, so that this method has the same disadvantages as described above.

THE INVENTION

It is the object of the invention, in a method and in an apparatus of the kind described in the beginning, to avoid the stated disadvantages. A rotation of the melt about the strand axis is to be brought about within the continuous casting mold without requiring induction coils for producing a rotating field or a rotation of the casting mold and of the steel strand emerging therefrom.

In the solution provided by the invention, the movement of the molten metal is brought about by the thrust of the gas which is directed at high velocity onto the bath surface. On account of the inertia of the metal and the downward movement of the strand, this rotatory movement extends deeply into the mold. A substantially simpler mode of operation is achieved in comparison with the known methods and apparatus, and the design of the plant can also be substantially simplified.

The gases in the gaseous or liquid state can be inert gases, reducing gases and, in the case of the continuous casting of rimmed steel, oxidizing gases. In the case of inert gases, in addition to the mechanical stirring action, a protection of the metal surface and of at least of a part of the cast strand is achieved, plus an additional cooling action, especially when a gas in the liquid state is used, and also a good distribution and protection against oxidation when additives such as aluminum are put into the mold. In the case of reducing gases, such as hydrocarbons, it is possible, in addition to the mechanical stirring action and protection against oxidation, to achieve a reduction of slags on the metal surface, thereby permitting an improvement of the purity of the steel and reducing the occurrence of flaws on the surface of the strand.

The continuous casting of rimmed steel has failed thus far for the reason, among others, that the boiling movement of the molten steel in the mold is too weak; consequently, the steel rises in the mold and the crown of gas bubbles is situated too close to the surface of the strand, resulting in break-offs in the casting and/or surface flaws which appear in the rolling. According to a further development of the method of the invention, therefore, in the continuous casting of rimmed steel, an oxidizing gas, such as oxygen, for example, is to be used as the stirring gas, for the purpose of increasing the oxygen content in the molten steel and hence increasing the boiling action.

The rotatory movement of the metal in the mold, which is brought about by the thrust of the gas, can be judged by the shape of the bath surface. If h is the difference in the height of the bath surface at the edge and at the middle, and if L is the inside diameter in the case of molds of round cross section, the length of a side, in molds of square cross section, the width between opposite sides, in molds of octagonal cross section, or the length of the shorter side, in molds of rectangular cross section, the ratio of h to L is to amount to 0.05 to 0.25.

The rotatory movement of the melt in the mold can be intensified by imparting a rotatory movement to the stream falling from the tundish. This can be accomplished, for example, by a special design of the pouring spouts and/or by blowing gases against the falling stream.

Especially in the case of strands having small, square cross sections, which is to say between 90 and 140 mm on a side, the short-radius corners commonly used in continuous casting molds (a radius between 6 and 10 mm is used for the avoidance of corner cracking) may interfere with the production of the rotatory movement of the melt, or it may lead to undesirable eddying on the edges of the strand, resulting in flaws. In such cases it is recommended that the radius of the corners be increased to 14 to 20 mm, i.e., to a dimension that is commonly used in rolled semifinished steel products.

Figure 2:
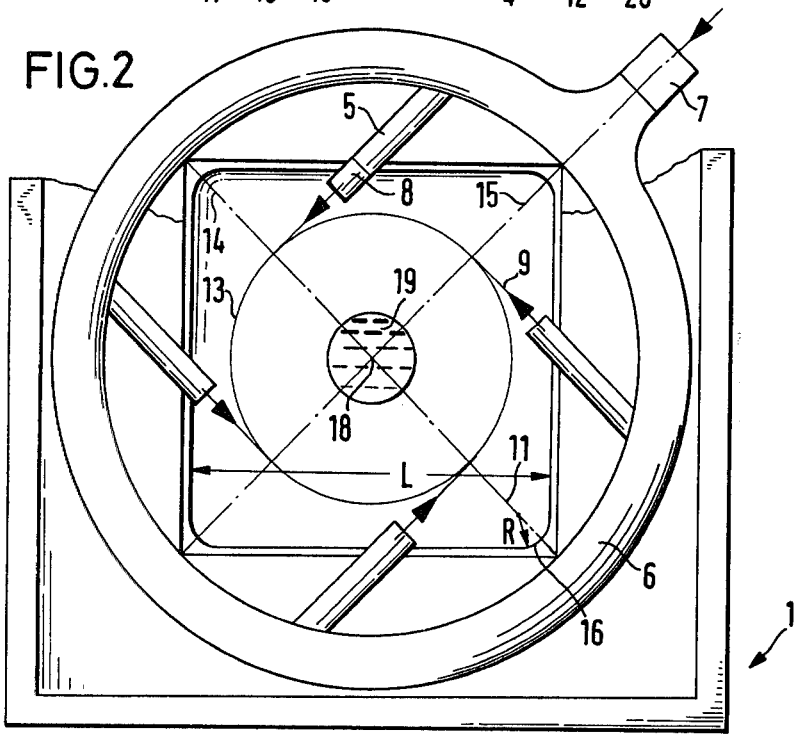
Figure 3:
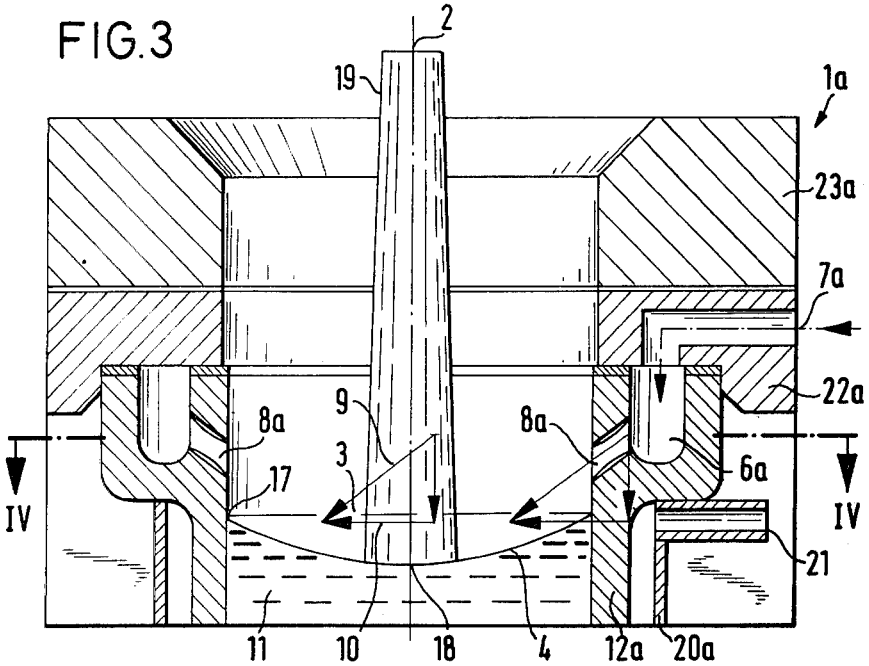
Figure 4:
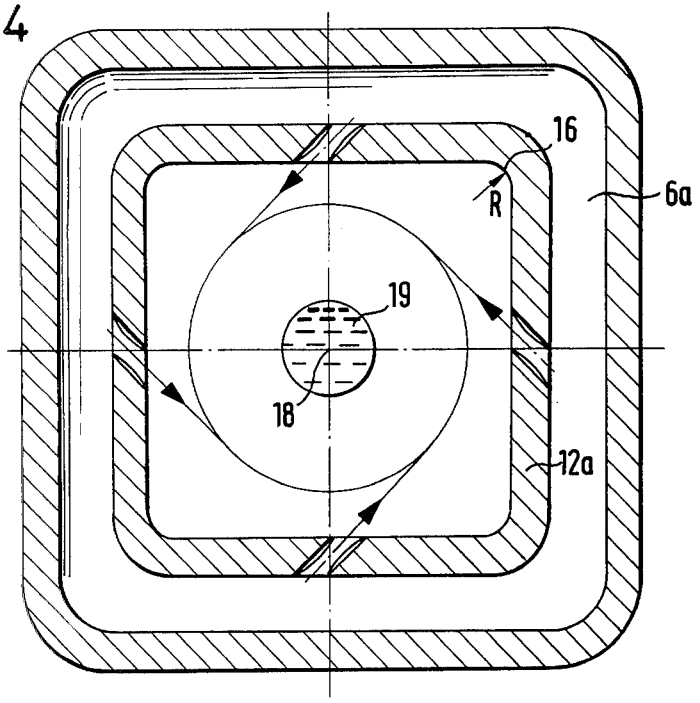
Figure 5:
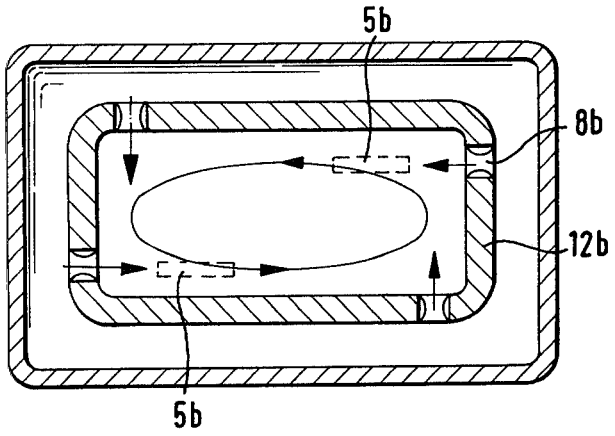
Figure 6:
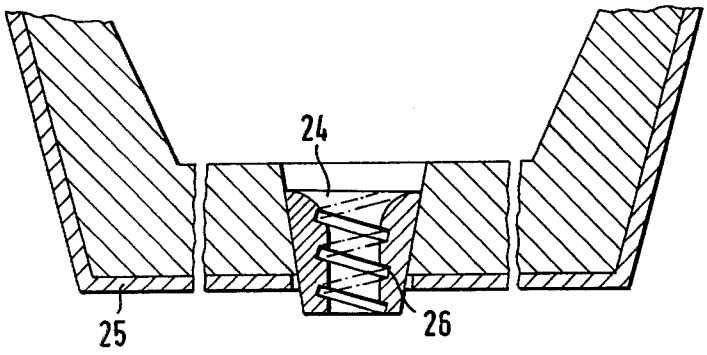

The invention will be further explained by means of embodiments in conjunction with six figures, of which FIGS. 1 and 2 are vertical and horizontal cross sections, respectively, of a portion of a continuous casting mold having gas feeding means disposed above the mold, FIGS. 3 and 4 are vertical and horizontal cross sections, respectively, of a continuous casting mold having gas feeding means in the upper section of the mold, FIG. 5 is a transverse cross section of a rectangular mold, and FIG. 6 is a vertical cross sectional view of the lower portion of a tundish.

In the embodiment represented in FIGS. 1 and 2, terminal fittings 5 of a manifold 6 carrying a gas in the gaseous or liquid state are disposed in the upper part of a continuous casting mold 1 and are aimed eccentrically with respect to the axis 2 of the mold and downwardly at an acute angle 3 to the surface 4 of the bath. The gas manifold 6, as best seen in FIG. 2, is in the form of an annular manifold having an inlet 7, from which four terminal fittings branch off around the mold in the selected example. These contain nozzles 8 at their discharge orifice, through which the gas is blown at high velocity against the bath surface. The direction of flow of the gas is indicated by arrows 9. The gas streams strike the bath surface at high velocity, and due to the thrust, which has a component 10 acting in a direction of rotation about the mold axis 2, the melt 11 is set into a rotatory movement.

In the example selected, the mold tube 12 has a square cross section. In order to achieve a highly uniform mixing action over the entire cross section, the four terminal fittings are disposed circumferentially about the strand such that the gas streams 9 are directed against the bath surface approximately at the points at which a circle 13 lying within the cross section intersects the diagonals 14 and 15 of the cross section. Furthermore, the radius R of the rounded corners 16 is larger than it usually is for the continuous casting of billets.

Due to the rotatory movement of the melt 11, the bath surface 4 assumes the form represented in FIG. 1. The ratio of the difference in height h between the edge 17 and the middle 18 of the bath surface 4 to the side length L of the mold 1 is a measure of the rotatory movement. The ratio is to be between 0.05 and 0.25. To intensify the rotatory movement, the casting stream 19 falling from the tundish can, as in the present case, drop coaxially into the continuous casting mold 1 and can be rotated about its own axis 2 in the same sense as the rotatory movement of the melt 11. Such a rotation of the casting stream can be achieved, for example, with the tundish pouring spout which is represented in FIG. 6.

FIG. 1 also shows a cooling jacket 20 having a conduit 21 for the coolant, a flange 22, and a mold shield 23. The regulating system for maintaining the bath surface at a constant level, which is also present in this case, has been omitted for reasons of clarity. A conventional pouring level regulating system can be used.

In the embodiment represented in FIGS. 3 and 4, the gas manifold is situated in the upper part of the mold. FIG. 4 shows the cross section taken along line IV—IV of FIG. 3, in which, however, the discharge orifices of the gas are represented in cross section along their axes in order to simplify the drawing. Wherever the parts are the same as in FIGS. 1 and 2, the same reference numbers have been used. Parts having the same function but differing in construction are distinguished by the addition of the letter a.

As shown in FIGS. 3 and 4, nozzles or nozzle-like orifices 8*a* are provided in the copper wall of the continuous casting mold tube 12*a*. These nozzles, which constitute the terminal fittings of the gas manifold, branch off from an annular passage 6*a*, which is provided in the upper part of the mold 1*a*. Through this arrangement it is brought about that the vectors 10 of the gas jets are lengthened in the direction of the rotatory movement of the melt 11 at the same gas pressure, and thus a stronger stirring action is achieved. Furthermore, the metal in the upper part of the mold is not only cooled directly by the gas blown at high velocity onto the bath surface, but also indirectly by the copper wall. The cooling is especially intense if a gas in the liquid state is used. The annular manifold 6*a* for the gas can be created, for example, by transversely dividing the conventional water cooling jacket of the mold above the bath level. The lower portion continues to serve for carrying water, while the upper part serves as a conduit for the stirring gas, or as a reservoir if the gas is in liquid form. For the sake of securely sealing from one another the two parts of the jacket carrying the water and the liquid stirring gas, they can also be in the form of two independent jackets which, as in the present example, are situated one over the other or are so arranged that the water cooling jacket closest to the mold wall is surrounded by a jacket containing liquid gas so as to cool the water. It is sufficient to provide this arrangement only in the upper part of the mold. The terminal fittings of the gas feed line would then pass not only through the copper mold tube, but also through the water cooling jacket.

Another variant of the invention is represented in FIG. 5, which represents a cross-sectional view of a rectangular mold. To achieve a rotatory movement of the melt over the entire cross section of the rectangular strand, nozzles 8b are so disposed in the sidewalls of the tubular mold 12b that the gas streams are directed against the bath surface in planes parallel to the sidewalls. The rotatory movement of the melt 11 is intensified by additional gas streams which are fed through terminal fittings 5b similar to the terminal pieces 5 of FIG. 1, which are represented in broken lines. In other words, the gas feeding systems of FIGS. 1 and 3 are here combined. This example will serve to indicate that, according to the particular requirements of the case, the discharge orifices for the gas blown at high velocity onto the bath surface can be disposed side by side and one above the other in the mold wall or else side by side and one over the other on tubes above the mold.

FIG. 6 shows a longitudinal cross section through the pouring spout 24 of the tundish 25 of a continuous casting system. The pouring spout contains spiral grooves 26 by which the pouring stream is set in rotation about its own axis. The direction of the spirals must be made such that the direction of rotation of the pouring stream will be identical with that produced by the thrusting action of the gas.

The embodiments described relate to the continuous casting of strands of square or rectangular cross section. The invention is applicable equally to the continuous casting of strands of round cross section or of slabs by means of conventional slab molds.

We claim:

1. In a continuous metal casting method, especially continuous steel casting method, in which the melt is set into rotatory movement about the strand axis within a continuous casting mold and gas in the gaseous or liquid state is fed onto the bath surface of the melt eccentrically to the mold axis and at an acute angle to the velocity vector of the rotatory movement, the improvement comprising: providing a substantially rectangular-shaped mold cavity, delivering molten metal into said mold cavity coaxially with said mold axis, and setting said melt into said rotatory movement substantially by the thrust of the gas directed onto said bath surface.

2. A continuous metal casting method according to claim 1, comprising: maintaining the level of the bath surface constant by a casting level control system.

3. A continuous metal casting method according to claim 1, comprising: setting said melt into said rotatory movement by the thrust of at least two gas streams, each having a velocity vector in the direction of rotation of the melt.

4. A continuous metal casting method according to claim 3, comprising: directing the gas streams against the bath surface approximately at the points of intersection of a circle lying within the cross section with the diagonals of the cross section.

5. A continuous metal casting method according to claim 3, comprising: directing the gas streams against the bath surface in planes parallel to the sides of the mold.

6. A continuous metal casting method according to claim 4 or 5, comprising: rounding off the corners of the strand cast by said mold, the radius of the round-off being between 14 and 20 mm.

7. A continuous metal casting method according to any one of claims 1, 2, 4 or 5, wherein the gas directed against the bath surface is an inert gas.

8. A continuous metal casting method according to any one of claims 1, 2, 4 or 5, wherein the gas directed against the bath surface is a reducing gas.

9. A continuous metal casting method according to any one of claims 1, 2, 4 or 5 for continuous casting of rimmed steel, wherein the gas directed against the bath surface is an oxidizing gas.

10. A continuous metal casting method according to any one of claims 1, 2, 4 or 5 in a mold having a mold tube, comprising cooling the mold tube by feeding the gas through an upper section of said tube.

11. A continuous metal casting method of any of claims 1, 2, 4 or 5, wherein the gas is directed against the bath surface at such a velocity that the rotatory movement of the melt which is produced by the thrusting action of all of the gas streams results in the formation of a bath surface having a ratio $$h:L=0.05 \text{ to } 0.25,$$

wherein:

h = difference in height of the bath between the edge thereof and the center thereof and, $L$ = side length in a mold of square cross section;

= length of the shorter side in a mold of rectangular cross section.

12. A continuous metal casting method according to any one of claims 1, 2, 4 or 5 comprising: delivering the pouring stream of the melt to the mold so as to rotate about its own axis in the direction of the rotatory movement of the melt.

* * * * *